United States Patent [19]

Goller et al.

[11] Patent Number: 4,765,158

[45] Date of Patent: Aug. 23, 1988

[54] DUST EXTRACTION APPLIANCE FOR FLAT KNITTING MACHINES

[75] Inventors: Ernst Goller, Reutlingen; Jochen Dieringer, Hechingen, both of Fed. Rep. of Germany

[73] Assignee: H. Stoll GmbH & Co., Reutlingen, Fed. Rep. of Germany

[21] Appl. No.: 106,274

[22] Filed: Oct. 9, 1987

[30] Foreign Application Priority Data

Oct. 15, 1986 [DE] Fed. Rep. of Germany ..... 3635096

[51] Int. Cl.[4] ..... D04B 35/32

[52] U.S. Cl. ..... 66/168

[58] Field of Search ..... 66/168

[56] References Cited

U.S. PATENT DOCUMENTS

| | | | |
|---|---|---|---|
| 2,045,509 | 6/1936 | Allred | 66/168 |
| 2,482,670 | 9/1949 | Imbriani | 66/168 |
| 3,461,693 | 8/1969 | Klaeui | 66/168 |
| 4,312,195 | 1/1982 | Nürk | 66/168 |
| 4,667,489 | 5/1987 | Seitz et al. | 66/168 |

FOREIGN PATENT DOCUMENTS

| | | | |
|---|---|---|---|
| 1930704 | 2/1970 | Fed. Rep. of Germany | 66/168 |
| 3130584 | 2/1983 | Fed. Rep. of Germany | 66/168 |
| 3305795 | 8/1984 | Fed. Rep. of Germany | 66/168 |

*Primary Examiner*—Ronald Feldbaum
*Attorney, Agent, or Firm*—Larson and Taylor

[57] ABSTRACT

In the dust extraction appliance for flat knitting machines, a vacuum is generated in the suction nozzles (17) by means of at least one suction-flow device (16) which is arranged on the slide of the flat knitting machine and into with a conveyed, via a flexible delivery line (20), compressed air which carries the sucked-up dust further into a dust collecting bag (18) via an exhaust-air duct (22).

6 Claims, 2 Drawing Sheets

DUST EXTRACTION APPLIANCE FOR FLAT KNITTING MACHINES

DESCRIPTION

The invention relates to a dust extraction appliance for flat knitting machines, with suction nozzles arranged adjustably on the slide and aligned with the needle bed or the needle beds, and with a dust collecting container carried by the slide.

A dust extraction appliance of the abovementioned type is known from German Offenlegungsschrift No. 3,506,142. The object on which the invention is based is to design a dust extraction appliance of the type mentioned in the introduction, so that there is no need for a special suction fan on the slide and the design of the dust collecting chamber can be simplified.

In a dust extraction appliance of the type mentioned in the introduction, the set object is achieved, according to the invention, because the suction nozzles are connected individually or severally to a suction-flow device, in which a vacuum causing the suction effect is formed by means of an inflowing compressed gas, and because the dust collecting container is designed as a dust collecting bag, through which is conveyed the compressed gas coming from the suction-flow device via an exhaust-air line. The compressed gas used is appropriately compressed air which can come from a compressed-air supply system, such as is present in many production shops, and which can advantageously be conveyed from the machine body to the slide via a flexible line.

By means of a dust extraction appliance designed according to the invention, there is no need to arrange on the slide of the flat knitting machine a separate suction fan in which the intake air has to be conveyed through the fan and therefore cleared of dust beforehand by means of a relatively high-grade filter device. The flexible compressed-air line can be tied in the trailing cable harness leading from the machine body to the slide. A simple dust collecting bag can be used as a dust collecting container, since the dust-laden exhaust air does not have to be conveyed through a suction fan.

In a preferred embodiment of the dust extraction appliance, the suction-flow device, together with the compressed-gas connection, the exhaust-air line connection and a suction-flow chamber, can be arranged on a slide stirrup, whilst the suction nozzles are anchored to the slide jaws carrying the lock parts. When the slide jaws are exchanged, there is no need to remove any lines of the dust extraction appliance, if, according to the invention, at least one suction orifice of the suction-flow device is located in a mounting surface of a slide stirrup, and if a suction duct opens out at the respective point in the mounting surface of the associated slide jaw, this suction duct extending in the slide jaw and leading to at least one suction nozzle. In this easily assembled embodiment, advantageously at least one O-ring gasket can be provided in the mounting plane between the slide stirrup and slide jaw, in order to seal off laterally the suction orifice of the suction-flow device. According to the invention, the danger that such an O-ring gasket will fall off if the slide jaw is assembled in a hurry can be avoided if an elastically deformable O-ring gasket is arranged between the rear side of a closing flange, resting with its front face against the edge of the suction orifice located in the slide stirrup and belonging to a suction tube or suction hose guided through the slide jaw, and the mounting surface of the slide jaw.

Appropriately, the dust extraction appliance designed according to the invention is also operated only at specific intervals. It is expedient if a suitably controlled compressed-air valve is arranged on the machine body, so that the flexible compressed-air line leading to the slide remains pressureless when the dust extraction appliance is disconnected. The suction lines leading to the suction-flow device can largely be incorporated in the slide jaws and generally kept short, so that there is no appreciable decrease in vacuum in the suction-nozzle lines. On the other hand, because compressed air coming from a compressed-air supply system is used, it is more easily possible to adjust the pressure in order to obtain a desired suction effect.

An exemplary embodiment of a dust extraction appliance designed according to the invention is explained in detail below with reference to the accompanying drawing which shows the parts of the dust extraction appliance which are essential to the invention.

Figure 1:
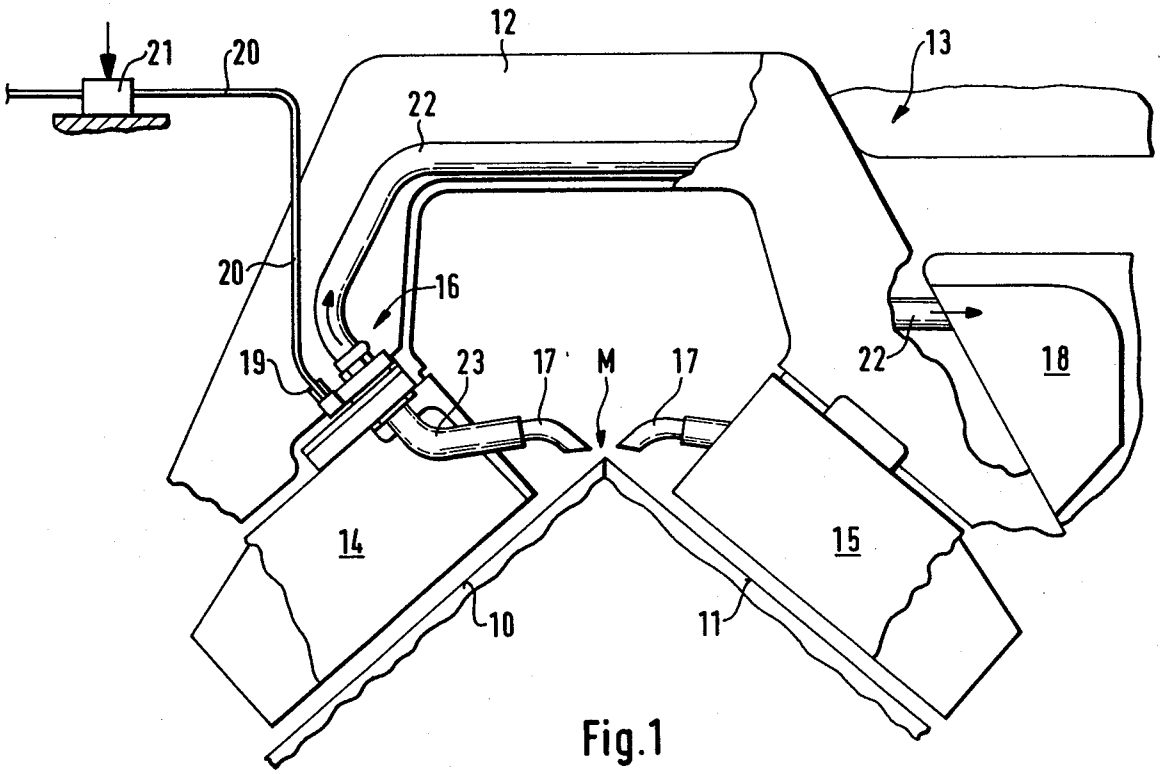
FIG. 1 shows a diagrammatic end view of the slide, equipped with a dust extraction appliance, of a flat knitting machine.

The diagrammatic representation of FIG. 1 shows merely diagrammatically the front needle bed 10 and the rear needle bed 11 of a V-bed flat knitting machine. Of the slide 13 of the flat knitting machine, a slide stirrup 12 with a slide jaw 14 for the front needle bed 10 and a slide jaw 15 for the rear needle bed 11 can be seen. Of the dust extraction appliance arranged on the slide 13, a suction-flow device designated as a whole by the reference numeral 16, two suction nozzles 17 arranged close to the knitting region M, and a dust collecting bag 18 fastened to the slide 13 are shown. The dust extraction appliance can have several suction-flow devices 16, at least one for each slide jaw 14 and 15. Moreover, several suction nozzles 17 can also be connected to one suction-flow device 16.

The suction-flow device 16 has a compressed-air connection 19, to which a flexible compressed-air line 20 leads. FIG. 1 indicates diagrammatically that this flexible compressed-air line is connected, via a switching valve 21 fastened to the machine body (not shown), to any compressed-air source, especially a compressed-air supply system of a factory plant. From the suction-flow device, an exhaust-air tube or exhaust-air hose 22 leads to the dust collecting bag 18. Each suction nozzle 17 is connected, via a suction duct 23 formed in the jaw 14 or 15 or guided through it, to one of the suction-flow devices 16, the design of which can be seen in detail in FIG. 2.

Figure 2:
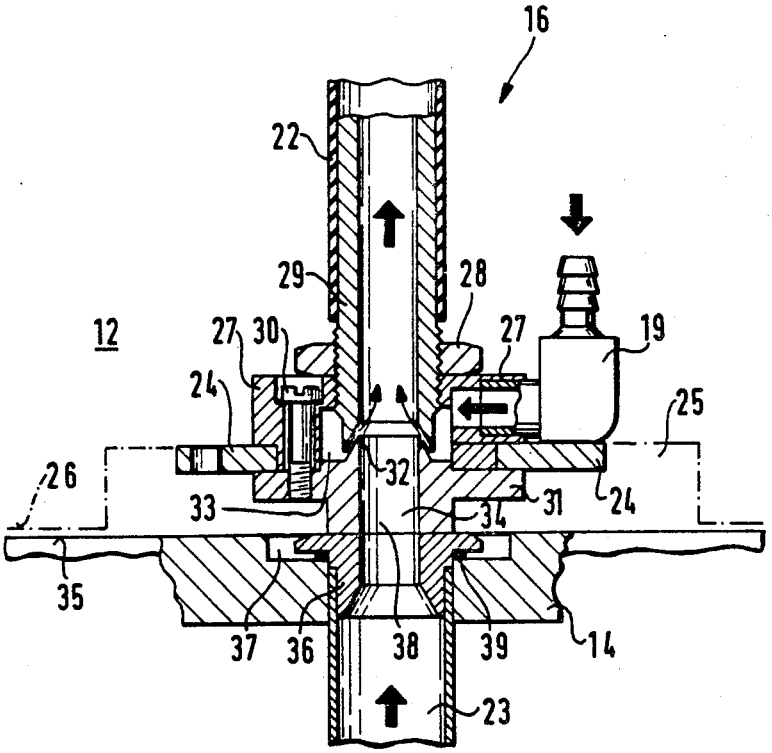
FIG. 2 shows a detailed view of the suction-flow device of the dust extraction appliance partially in a central longitudinal section and on a scale larger than that of FIG. 1.

FIG. 2 shows the housing 27 of the suction-flow device 16, this housing being fastened by means of an assembly plate 24 in a recess 25 of the mounting surface 26, indicated by dot-and-dash lines, of the slide stirrup 12. The housing 27 carries the compressed-air connection 19. Inside the housing 27 a flow nozzle 32 connected to an annular chamber 33 is formed between the inner conical end of a screwed-in sleeve body 29, secured by means of a coupling nut 28, and an extension body 31 fastened to the housing 27 at the bottom by means of screws 30. The compressed air flowing in via the compressed-air connection 19 first enters the annular chamber 33 in the direction of the marked arrows and through the flow nozzle 32 into the sleeve body 29, to which the exhaust-air tube 22 is connected. By means of the flow nozzle 32, a vacuum is generated in the passage duct 34 of the extension body 31.

The outer orifice of the passage duct 34 of the extension body 31 is located in the mounting plane 26 of the slide stirrup 12. In the associated mounting plane 35 of the slide jaw 14 fastened releasably to the slide stirrup 12, the suction line 23 designed as a tube ends in a flanged bush 36, the flange of which is arranged in a shallow clearance 37 in the slide jaw 14. When the slide jaw 14 is fastened to the slide stirrup 12, the flanged bush 36 aligned with the suction orifice 38 of the suction-flow device 16 rests by means of its outer face against the extension part 31. Arranged in the clearance 37 between the rear side of the flange of the flanged bush 36 and the slide jaw 14 is an elastically deformable sealing ring 39 which, when the slide jaw 14 is fastened to the slide stirrup 12, is compressed and thus guarantees that the flanged bush 36 comes sealingly up against the extension part 31. When the slide jaw 14 is removed from the slide stirrup 12, there is no need to detach any line connections.

We claim:

1. A dust extraction system for a flat knitting machine having a slide which moves relative to needle beds comprising:

a plurality of suction nozzles adjustably mounted on the slide and in alignment with the needle beds;

a suction source mounted on the slide and connected to said plurality of nozzles, said suction source including at least one suction flow device having (a) a connection inlet and a suction outlet, and (b) a vacuum forming means for forming a vacuum when a compressed-gas flows through said connection inlet;

a flexible delivery line connected at one end to said connection inlet and at the other end to a compressed-gas supply which is stationary; and a dust collection bag mounted on the slide and connected to said suction outlet of said at least one suction flow device.

2. A dust extraction system as claimed in claim 1 wherein said flexible delivery line includes a controlled compressed-gas valve for an intermittent actuation of said suction flow device, said valve being stationary.

3. A dust extraction system as claimed in claim 1 wherein the slide of the flat knitting machine includes a slide stirrup and slide jaws; and wherein said suction flow device is mounted on the slide stirrup and said suction nozzles are mounted on the slide jaws.

4. A dust extraction system as claimed in claim 1 wherein the slide of the flat knitting machine includes a slide stirrup having a mounting surface and slide jaws having respective mounting surfaces;

wherein said suction flow device includes at least one suction orifice having an inlet located at the mounting plane of the slide stirrup and an outlet located at said vacuum forming means; and further including a suction duct which connects at least one of said nozzles to said suction flow device, said suction duct passing through a respective said slide jaw and having (a) a duct outlet adjacent to said inlet of said suction orifice and located at the mounting surface of the associated slide jaw and (b) a duct inlet connected to said nozzle.

5. A dust extraction system as claimed in claim 4 and further including at least one O-ring gasket provided adjacent the mounting plane of said slide jaw and around said suction duct to seal said suction duct laterally.

6. A dust extraction system as claimed in claim 5 wherein said duct outlet includes a closing flange thereabout, said closing flange having a front face against which said inlet of said suction orifice mates and a rear face adjacent a surface of the slide jaw with said O-ring gasket being elastically deformable and positioned between said rear face and the surface of the slide jaw.

* * * * *